US006614337B1

(12) United States Patent
Winnard

(10) Patent No.: US 6,614,337 B1
(45) Date of Patent: Sep. 2, 2003

(54) MAGNETIC HOLDING DEVICE

(76) Inventor: Stanley D. Winnard, 2528 Clearspring Dr. North, Irving, TX (US) 75063

( * ) Notice: Subject to any disclaimer, the term of this patent is extended or adjusted under 35 U.S.C. 154(b) by 0 days.

(21) Appl. No.: 09/342,378

(22) Filed: Jun. 29, 1999

(51) Int. Cl.[7] ..... H01F 7/20
(52) U.S. Cl. ..... 335/285; 335/286; 206/350
(58) Field of Search ..... 335/285–288, 335/302, 306; 206/350, 818; 269/8; 224/183

(56) References Cited

U.S. PATENT DOCUMENTS

| | | | | |
|---|---|---|---|---|
| 3,505,377 A | | 4/1970 | Morehouse | 260/448.2 |
| 4,591,817 A | | 5/1986 | Miller | 335/285 |
| 4,802,580 A | | 2/1989 | Andersen | 206/378 |
| 5,080,230 A | | 1/1992 | Winnard | 206/350 |
| 5,456,359 A | * | 10/1995 | Horn | 206/378 |
| 5,458,785 A | * | 10/1995 | Howe et al. | 210/695 |
| 5,500,631 A | | 3/1996 | Negus | 335/285 |
| 5,669,516 A | * | 9/1997 | Horn | 206/350 |

* cited by examiner

*Primary Examiner*—Ramon M. Barrera

(57) ABSTRACT

A magnetic holding device for storing and organizing tools that are intrinsically or have been made magnetically conductive is disclosed that includes a first plate having a width, a thickness and at least one opening and a magnet having a first and a second magnetic region attached to the first plate, wherein the magnetic regions of the magnet are located on opposite sides of the at least one opening in the first plate.

15 Claims, 3 Drawing Sheets

MAGNETIC HOLDING DEVICE

TECHNICAL FIELD OF THE INVENTION

The present invention is directed to an improved structure and apparatus for storing and holding tools, and more particularly, it relates to a structure that focuses magnetic fields for storing and organizing small hand tools.

BACKGROUND OF THE INVENTION

Without limiting the scope of the invention, the background is described in connection with structures for the storage and organization of tools that are attracted by magnets using the combination of a magnet and a plate positioned to focus magnetic fields.

Heretofore, in this field, small hand tools and implements have been organized using, for example, pressure fitted holders such as molded plastic organizational supports. Another example of such devices is a pressure-fitted holder having a variety of small spring clips that are connected to a central rail in which sockets are positioned in the outward protrusion from the spring clips. The spring clips are configured to insert into the drive opening of a socket. Spring clips also may be designed to hold other small tools, such as a socket ratchet or a screwdriver.

The spring clips of the prior art are designed to insert the drive ends of, e.g., ¼, ⅜, or ½-inch square drive ratchet sockets. One disadvantage of spring-clip systems, however, is the limitation imposed by the size of the different socket drive-sizes as the spring clips must match the specific socket size. Another problem of spring clip socket holders is they may easily be deformed during use causing the socket to fit too tightly or too loosely. If the spring clip becomes loose, a socket can easily become dislodged from the spring clip or may not be secured by the spring clip at all. Conversely, if the spring clip is deformed so that it fits too tightly within the socket drive opening, it becomes difficult to attach and remove the socket from the clip. Attempts to either adjust the tightness of the spring clip or to withdraw a socket that is held too tightly to the clip often cause adjacent sockets to be dislodged.

Spring clips have been forbidden for use in the aircraft industry because of their potential as a foreign object or debris (FOD). FOD is a major problem in the aircraft industry due to reliance in the industry on highly efficient jet engines. Highly efficient jet engines are obtained at the cost of decreased ruggedness. Because the worldwide airline industry is turning toward more efficient engines, the interior of these engines must be protected from FOD.

In the past, there have been various constructions combining molded, nonmetallic materials with magnets to provide a holder for metal sockets. See, for example, Applicant's U.S. Pat. No. 5,080,230.

U.S. Pat. No. 3,405,377 issued to Pierce discloses a construction that includes a series of parallel boards of nonmetallic material.

U.S. Pat. No. 4,802,580 issued to Anderson discloses a construction where parallel plates sandwich the magnetic material.

U.S. Pat. No. 4,591,817 issued to Miller discloses a socket holder that includes plate a.matures that are laminated with magnetic material to define an assembly for holding sockets. To facilitate the alignment of items being retained, a third parallel plate is provided.

U.S. Pat. No. 5,500,631 issued to Negus discloses a magnetic holder that includes a molded plastic tray with a sinter bar having laminated keeper plates and magnetic bars positioned to define pole pieces that permit the forming of magnetic circuits.

U.S. Pat. No. 4,802,580 issued to Andersen discloses a pair of elongated, parallel and laterally spaced armature plates in which a plurality of magnets are mounted in positions spaced along the plates. The plates are constructed of ferrous material. The armature plates are assembled using a plurality of threaded fasteners that extend through the multiple plates and secure the armature plates. Due to the complexity of assembling the unit and the use of multiple small parts that comprise the magnetic socket holders described therein, the invention fails to address the requirements for reduced components; components that may become entrapped in a jet engine, i.e., FOD. Furthermore, the unit requires multiple steps for assembly, making automation of manufacturing the unit difficult and expensive.

SUMMARY OF THE INVENTION

All of these prior designs, however, have like flaws. During use, it has been found that the magnetic strength of these holders decreases as more sockets are added causing the socket holder to fail unless maintained in the horizontal position.

The present invention addresses the need for a universal magnetic tool organizer with improved magnetic strength using magnets of lesser strength than used in the past. Furthermore, the structure should be customizable to increase or decrease magnetic field strength by changing the structure or the strength of the magnet.

Needs similar to those of the airline industry are found in mechanic shops. In mechanic shops, for example, the need for safety is matched by the need to decrease the space needed to store an ever larger number of specialized tools and to reduced cost due to lost time finding tools and savings from a reduced need in the replacement of tools. As part of the increasing spacial constraints in a mechanic's shop or airline hanger, the present invention addresses the need for vertical stackability of tool organization and for rapid automated assembly of the magnetic holding device and placement of the tools in the holder.

More particularly, the present invention is a magnetic holding device that includes first and second plates, each of the plates having a width and a thickness. A magnet having a width that is less than the width of at least one of the plates, is positioned between the first and second plates. The magnetic holding device may further include two or more plates positioned adjacent to each other and on a magnet having a width less than that of one of the plates to form a channel between two or more of plates and two or more magnets. The magnetic field formed between the magnets and the plates is concentrated about each of the channel or channels.

Tools such as pliers, wrenches, ratchets and the like, for example, may be retained by contacting them with the second plate, which is generally made of a magnetically conducting material. The field strength may be varied depending on the weight of the tool and the amount of strength that the user expects to use to remove the tool from the magnetic holding device.

The present invention may further include an attachment magnet, opposite the magnet from one of the plates, wherein the attachment magnet contacts,.for example,.a tool storage structure to hold the magnetic holding device. The attachment magnet of the magnetic holding device, however, may also be used to position the magnetic holding device on any magnetically attractive surface, such as a vertical storage system, the hood of a car, or even the undercarriage of a vehicle or airplane.

A wide variety of different magnets, including permanent magnets, may be used as either the first or the second magnet. Magnets that may be used with the present invention include rare earth, neodymium, alnico, ceramic or flexible magnets. The magnets may be cut into strips or may be cut to form the required shape. The magnets may be rigid, flexible or of semi-rigid construction using a wide variety of magnetic materials, e.g., rare-earth, alnico, ferrite and the like. The dimensional features of the magnet will generally be designed to maximize field strength by having a proportional recess from the dimensions of the second plate.

In another embodiment of the present invention the apparatus may further include adjacent magnets and plates that form channels between them. Other useful features may be, if appropriate, a handle, hooks or other attachments for connection to a tool storage structure, holes for attachment with screws or rivets and the like. The first and second plates of the magnetic holding device may even be riveted, glued or soldered at the ends or internally. In the case of a handle, it may be pivotable about its attachment.

In yet another embodiment, the first magnet is a unipolar magnet or a multipolar magnet. The first and second magnets may be attached to a plate or plates by an adhesive, or may rely solely on magnetic forces to attach to a metallic or magnetically conductive plates. The second magnet may serve to attach the apparatus of the present invention in a vertical or horizontal organization system to keep from sliding at any angle. The second magnet may be integral to the apparatus of the present invention or to a vertical storage system.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE PREFERRED EMBODIMENTS

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention and do not delimit the scope of the invention.

Figure 1:
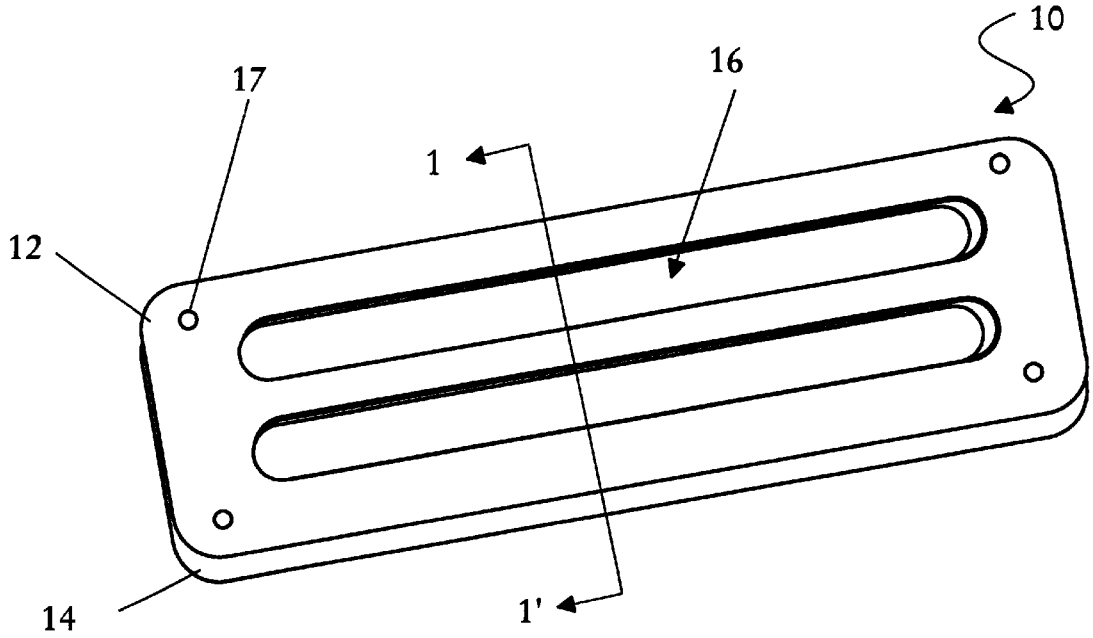
FIG. 1 is a perspective view of a magnetic holding device of the present invention.

Referring now more specifically to the drawings, FIG. 1 shows a perspective view of a magnetic holding device of the present invention, generally designated 10. The magnetic holding device 10 is depicted including a first and a second plate 12 and 14. Openings 16 are depicted that may form a channel within the first plate 12, while the second plate 14 does not have openings. The first and second plates 12, 14 are made of a magnetically conductive material, which can be a ferrous material or another material that contains sufficient magnetically conductive material to transfer or attain magnetic qualities.

Attachment points 17 may be provided and are depicted at four positions on first plate 12 and may be, for example, rivets, screws and like forms of attachment. The first and second plates may even be of unitary or single-plate construction, where one piece is folded in one or more ways to place the first and second plates generally parallel to each other.

When formed from one piece, the first plate 12 may be formed with the slots that form openings 16 while the second plate 14 may or may not have openings. Furthermore, it will be appreciated by those of skill in the art in light of the present disclosure that the openings 16 and the plates are not necessarily perpendicular or even generally rectangular. The openings 16 may be formed in a variety of shapes and widths depending on the type of object that will be placed in the magnetic holding device 10.

Figure 2:
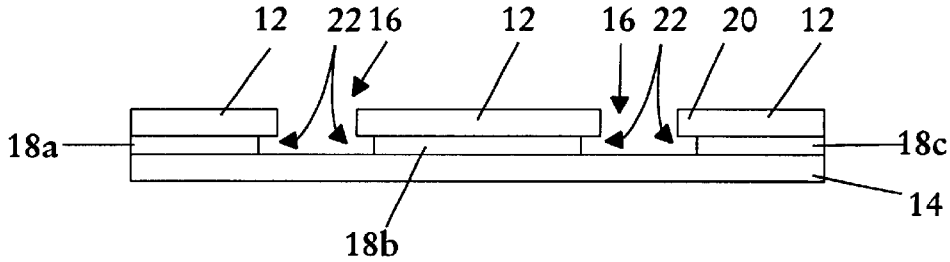
FIG. 2 is cross-sectional views along the 2–2' line of a magnetic holding device of the present invention.

FIG. 2 is a cross-sectional view along line 1–1' of FIG. 1 and depicts a magnets 18*a*, 18*b* and 18*c* between the first plate 12 and the second plate 14. Each magnet 18*a, b, c*, in one embodiment of the present invention, is a unipolar magnet in which a single pole of a magnetic field is formed perpendicular to the surface of the magnets 18*a, b* or *c*. The magnetic field components of the unipolar magnet are generally perpendicular to the surface of the first and second plates 12, 14 and may be of about 1/16 th to 1/4 th of an inch in thickness. As depicted in FIG. 2, the magnets 18 in each of the cases has a width that is less than the width of the portions of the first plate 12 that are over the magnets 18*a, b, c*. Alternatively, the width of the magnets 18*a, b, c* may be about equal to the width of the portion of plate 12 that is positioned over the magnets 18*a, b, c*.

A lip 20 is defined by the region of the first plate 12 that extends over and past the magnets 18*a, b, c* into the opening 16. The area within the opening 16 that is below the lip 20 and the magnets 18*a, b, c* is a recessed region 22. As depicted in FIG. 2, the central magnet has recessed regions 22 on each side, while the end portions of the magnetic holding device 10 are not recessed.

The arrangement of the poles for the magnets 18 as depicted may be an N-S-N or an S-N-S configuration. It has been found particularly useful, however, to attempt to match the total width of a central region as depicted with the total width of the adjacent regions, whether in an N-S-N or an S-N-S polar configuration. If more magnets 18 are used adjacent to each other, or if a series of strips are used, whether linear, circular or of any other shape, the same principle may be applied, namely, that the total strength, not just width or size, of the polar regions are matched as best possible.

Figure 3:
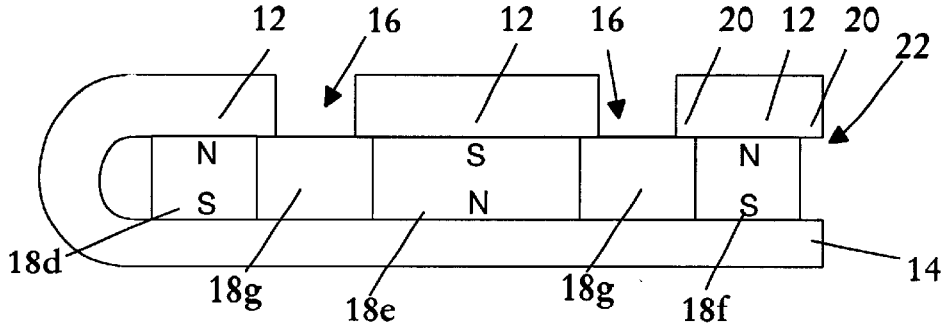
FIG. 3 is a cross-sectional view of an alternative embodiment of the magnetic holding device of the present invention.

FIG. 3 is a cross-sectional view generally along line 1–1' of FIG. 1 and depicts a s ingle magnet 18 having magnetic regions 18*d*, 18*e* and 18*f* between the first plate 12 and the second plate 14. The first and second plates 12 and 14 are formed from a single piece that is folded. Magnetic regions 18*d, e, f* form part of a multi-polar magnet in which the magnetic fields of the magnet run adjacent the openings, with null portions 18*g* separating the magnetic portions of the multi-polar magnet 18. The magnetic pole of the magnetic regions 18*d*, 18*e* and 18*f* are alternated in an N-S-N or a S-N-S configuration. It will be apparent to those skilled in the art that the number of magnets 18*a, b, c* or magnetic regions 18*d, e* and *f* will be increased to match the number of openings 16.

As with the other embodiments of the present invention, the magnet 18 may also be unipolar, multi-polar, or may even be a combination of uni- and multi-polar magnets 18. The magnetic field components of a uni-polar magnet are generally parallel to the surface of the first and second plates 12, 14 and may be of about 1/16 th to 1/4 th of an inch in thickness.

As with the magnetic holding device 10 depicted in FIG. 2, the central magnet 18 has a width that is less than or equal to the width of the portions of the first plate 12 that overhang the magnet 18. In the configuration depicted in FIG. 3, however, recessed region 22 are shown on both ends of the cross-sectional view, causing greater concentration of the magnetic fields. Also, if formed as a pad, the magnet 18 may on all four sides, that is, both in length and width, have less width and length than the overlying first plate 12. In order to hold the magnet or magnets 18 in place with the first plate or plates 12, the second plate 14 will generally be formed as a single piece, or pieces that are permanently or semi-permanently attached.

Figure 4:
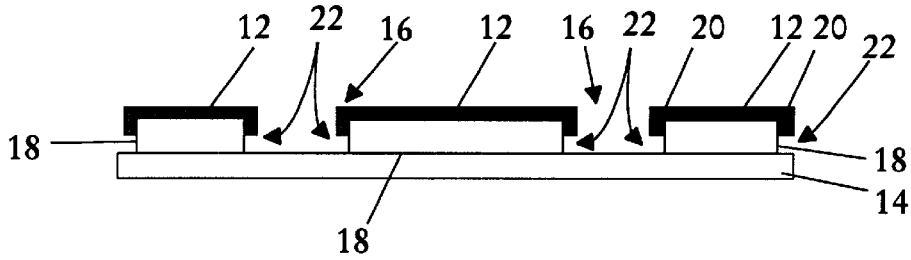
FIG. 4 is a diagram of an alternative embodiment of the magnetic holding device of the present invention.

FIG. 4 is also a cross-sectional view along line 1–1' of FIG. 1 and depicts a magnet 18 between the first plate 12 and the second plate 14. As depicted in FIG. 3, the magnet 18 has a width that is less than the width of the first plate 12 over the magnet 18 and forms recessed region 22 on both sides of the magnet 18. In the configuration depicted in FIG. 4, however, further tuning of the magnetic field is achieved by wrapping around or over at least a portion of the magnet 18 with the ends of the first plate 12. Recesses 22 are still formed, but in the configuration depicted, the recesses 22 are partially open and partially filled with the overhang of the first plate 12. In one configuration, the length of the overhang that covers the sides of the magnet 18 is about the same as the thickness of the first plate 12.

Figure 5:
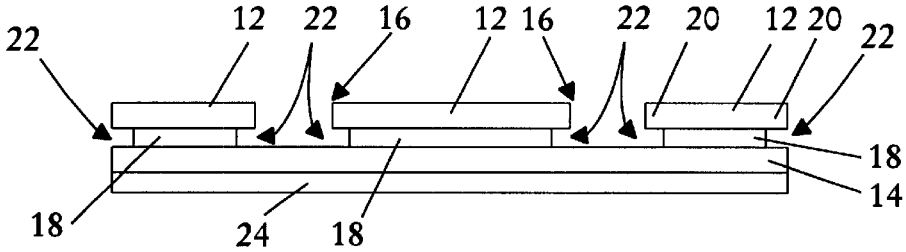
FIG. 5 is a diagram of another embodiment of the magnetic holding device of the present invention.

FIG. 5 is a cross-sectional view along line 1–1' of FIG. 1 and depicts a magnet 18 between the first plate 12 and the second plate 14. In this configuration, an attachment magnet 24 is shown that may be used to position the magnetic holding device 10 on any type of magnetically attractive surface for retention of the magnetic holding device 10. One such structure, for example, may be a vertical tool storage system.

As depicted in FIGS. 2, 3 and 4, the magnet 18 has a width that is less than the width of the portions of the first plate 12 that are over the magnet 18. As with the magnet 18, the attachment magnet 24 may be a uni- or multi-polar magnet and may be of any of the types of permanent magnets known to those of skill in the art. Examples of types of permanent magnets for use with the present invention are described hereinbelow.

Figure 6:
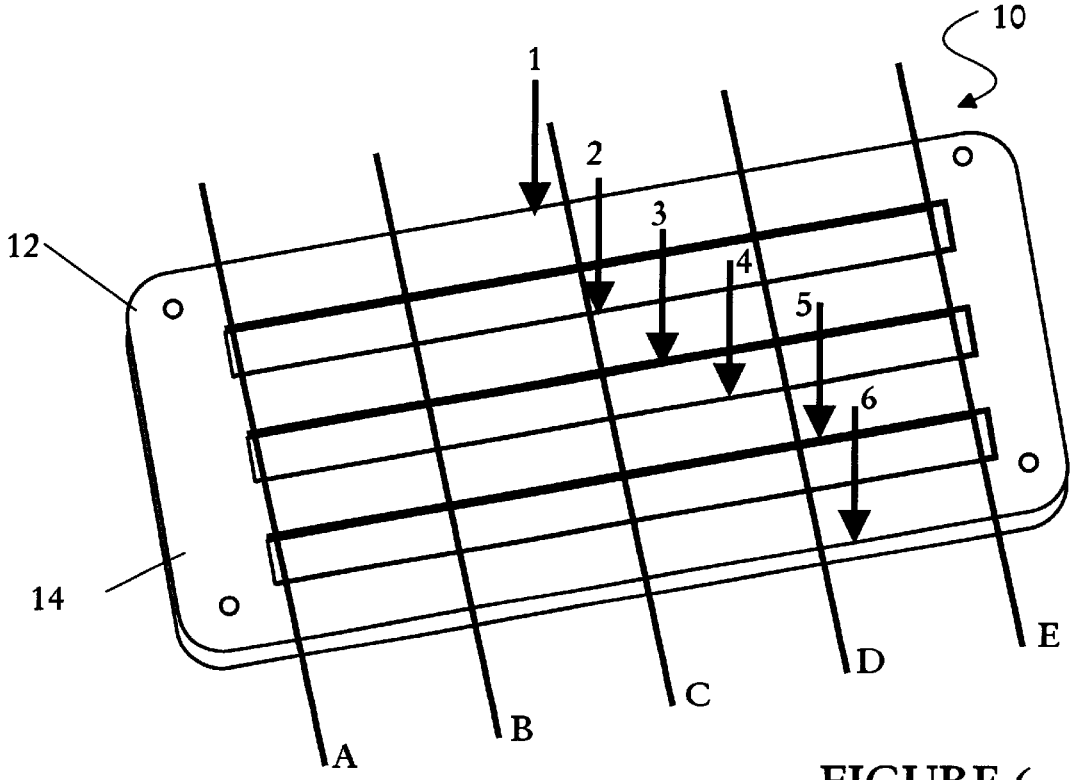
FIG. 6 is a perspective view a magnetic holding device of the present invention showing the position where strength measurements were taken.

FIG. 6 is a perspective view of a magnetic holding device 10 having three channels and is used to show the positions where the measurements shown in Table 1 were taken. The numbered positions, one through six, show the position on the magnetic holding device 10 where measurements were taken using an FM14 (Flexmag Ind., U.S.A.) magnet with a width of 0.5 inches and 0.125 inch thickness. The first plate 12 used was 0.18 gauge steel. The readings, in gauss, were taken at the steel surface along the lettered lines, giving the five by six matrix of Table 1.

TABLE 1

| | 1 | 2 | 3 | 4 | 5 | 6 |
|---|---|---|---|---|---|---|
| A | 397 | 1010 | 950 | 995 | 940 | 420 |
| B | 371 | 1000 | 930 | 1040 | 930 | 402 |
| C | 371 | 980 | 966 | 1050 | 945 | 402 |
| D | 380 | 1000 | 970 | 1020 | 940 | 397 |
| E | 397 | 1050 | 975 | 1020 | 970 | 410 |

In another example comparing the relative strength of the magnetic fields between three different configurations, the present invention was found to increase the magnetic field strength up to 60%. The three configurations tested were: (1) where the first plate and the magnet had the same width with three magnets adjacent to each other in an N-S-N configuration (2) where the first plate had a greater width than the magnet but the recessed ends were only in the internal portions of the magnetic holding device as depicted in FIG. 2, three magnets adjacent to each other in an N-S-N configuration; and (3) where the first plate had a greater width than the magnet and the recessed ends were both internal and external to the magnetic holding device depicted in FIG. 3, three magnets adjacent to each other in an N-S-N configuration. For example, using equivalent plate thicknesses and magnetic strengths, a device with the first configuration was rated at 15.6 lbs using a single test weight, the device in the second configuration has a strength of 22 lbs, and the device in the third configuration a strength of 31 lbs. The test weight was a single ½ inch steel pipe to which increasing weights were attached until the steel pipe was no longer held.

Figure 7:
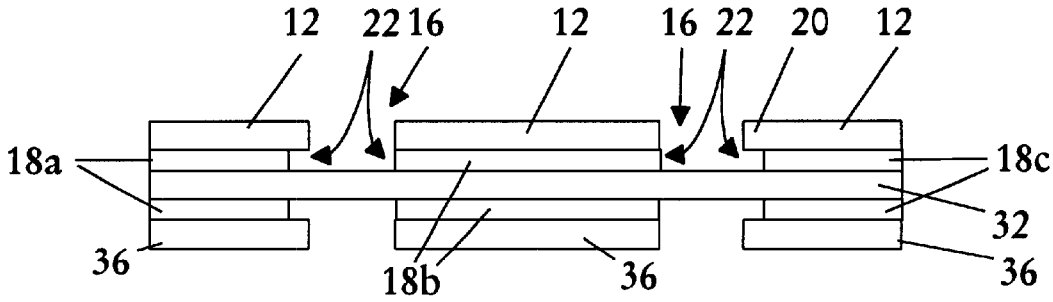
FIG. 7 is a cross-sectional view of a three-piece drawer divider configuration.

FIG. 7 is a cross-sectional view of a three-piece drawer divider 30 is depicted in which a central solid plate 32 is used to provide strength to the magnetic holding device to be inserted in a vertical or horizontal tool storage device to provide and has dual or two-sided magnetic holding sides. Magnets 18 are positioned adjacent the plate 32 with plates 36 on the opposite side of magnet 18 from the plate 32. In this configuration, both sides of the magnetic tool holder may be used to provide both horizontal or vertical holding capacity as well as provide for drawer dividers.

Figure 8:
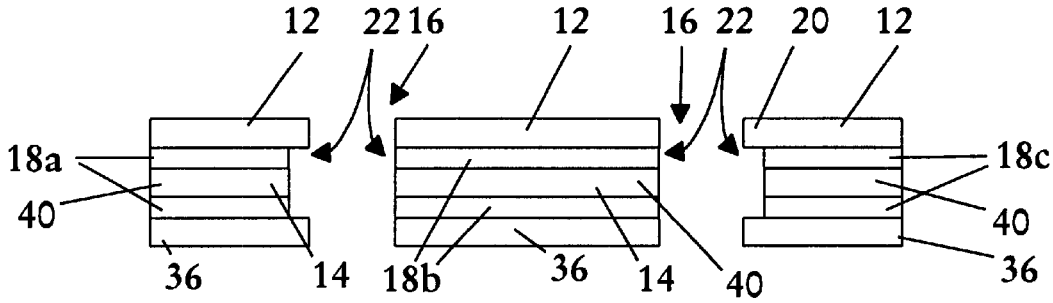
FIG. 8 is a cross-sectional view of a two-piece slotted drawer divider.

FIG. 8 is a cross-sectional view of a two-piece slotted drawer divider in which the central plate 40 is not solid, but rather, has openings 16 that generally match the locations of openings in the plate 36. Using this configuration items may be placed that are not only held by the magnetic attraction of the magnets 18, but also by the mechanical constraint provided by fitting in the opening 16.

Figure 9:
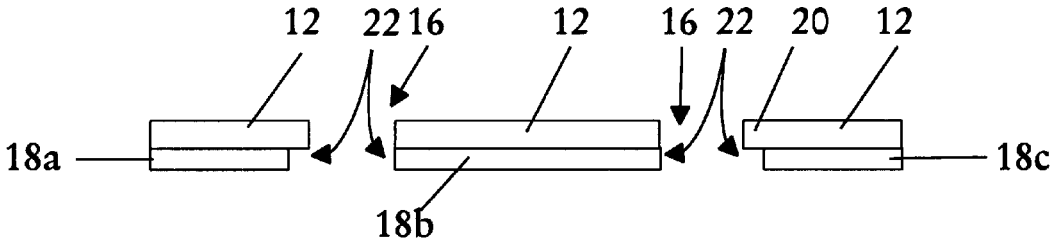
FIG. 9 is a minimal magnetic holding device of the present invention.

FIG. 9 is a minimal magnetic holding device of the present invention that may be used to attach the magnetic tool holder 10 of the present invention on any surface. If the surface is magnetically attractable then the magnetic tool holder 10 is attached by the magnetic field. Alternatively, the minimal magnetic tool holder may be adhered or fastened to the surface while still providing the advantages of the present invention.

The present invention may be used to support sockets as the tools being supported by the magnetic holding device 10 of the present invention. Other tools, however, can be used and supported by the magnetic holding device 10 of the present invention described herein, as will be known to one of ordinary skill in the art in light of the present disclosure.

A wide variety of permanent magnets may be used with the present invention such as rare earth magnets, ceramic magnets, alnico magnets, which may be rigid, semi-rigid and flexible magnets. Flexible magnets are made by impregnating a flexible material such as neoprene rubber, vinyl, nitrile, nylon or a plastic with a material such as iron flakes having magnetic characteristics and will find use with the present invention.

Other examples of magnets for use as described hereinabove, are rare earth magnets include neodymium iron boron (NdFeB) and Samarium Cobalt (SmCo) classes of magnets. Within each of these classes are a number of different grades that have a wide range of properties and application requirements. Rare earth magnets are available in sintered as well as in bonded form.

Ceramic magnets are sintered permanent magnets composed of Barium Ferrite ($BaO\ (Fe_2O_3)_n$) or Strontium Ferrite ($SnO\ (Fe_2O_3)_n$), where n is a variable quantity of ferrite. Also known as anisotropic hexaferrites, this class of magnets is useful due to its good resistance to demagnetization and its low cost. While ceramic magnets tend to be hard and brittle, requiring special machining techniques, these magnets can be used in magnetic holding devices having very precise specifications. Anisotropic grades are oriented during manufacturing, and must be magnetized in a specified direction. Ceramic magnets may also be isotropic, and are often more convenient due to their lower cost. Ceramic magnets are useful in a wide range of applications and can be pre-capped or formed for use with the present invention.

Flexible magnets are magnets made of materials that are flexible and bonded with a magnetic material. Flexible magnets offer the product designer a uniquely desirable combination of properties at a low cost. The advantage of materials that are flexible and bonded with a magnetic compound is that they may be bent, twisted, coiled, die punched, and otherwise machined into almost any shape without loss of the magnetic field. Under normal working conditions, flexible magnets are desirable due to their lack of a need for coating, are corrosion resistant, are easily machined, are easily handled, and may be bonded with a magnetic material having a high magnetic energy.

More expensive magnetic material, such as rare earth metal magnets, can be coated onto a flexible backing material, such as plastic, nylon or polypropylene, and will provide excellent magnetic strength and flexibility. In addition, the flexible magnets may be made very thin, e.g., with thicknesses of 1/18 th of an inch or less.

Flexible magnets may also be attached to the magnetic holding device of the present invention using adhesives that are suitable for a wide range of environments. The type of adhesive used to attach the flexible magnet will depend on the particular application, for example, the adhesive may be pressure sensitive. The magnet(s) may be laminated with, e.g., a pressure sensitive adhesive. Adhesives for use with the present invention will be known to those of skill in the art.

Alnico magnets are composed primarily of alloys of aluminum, nickel and cobalt and are characterized by excellent temperature stability, high residual inductions, and relatively high energies. Alnico magnets are manufactured through either a casting or sintering process. Cast magnets can be manufactured to very high specifications and can have very specific shapes. Sintered alnico magnets offer slightly lower magnetic properties but better mechanical characteristics than cast magnets.

Alnico magnets are very corrosion resistant. While Alnico magnets are easily demagnetized, this problem may be overcome with simple handling instructions. Advantage of alnico magnets is the smaller effect that temperature has on its magnetic properties.

While this invention has been described in reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

What is claimed is:

1. A method of holding a ferrous object comprising:

providing a first plate having a width, a thickness and at least one opening;

providing a first and a second magnetic region attached to the first plate, wherein the magnetic regions are located on opposite sides of a null region spanning the at least one opening in the first plate; and placing the object against the side of the first plate opposite the magnetic regions in such an orientation that at least some portion of the object lies over some portion of the opening.

2. The method of claim 1, further comprising the step of providing a second plate opposite the first plate from the magnetic regions.

3. The method of claim 2 wherein a channel is formed in the opening between the magnetic regions, and wherein the magnetic field formed between the magnetic regions and the plates are concentrated about the channel.

4. The method of claim 1, wherein the strength of the magnetic field is varied by changing the strength of the magnetic regions.

5. The method of claim 1, wherein the magnetic regions is rigid, semi-rigid or flexible.

6. The method of claim 5, wherein the permanent magnetic regions are formed by a neodymnium, an alnico, a ceramic or a ferrite magnet.

7. The method of claim 1, wherein the magnet poles alternate between adjacent magnetic regions.

8. The method of claim 1, wherein the first plate is a magnetically conductive plate.

9. The method of claim 1, wherein the first plate comprises a non-magnetically conductive material coated with a ferrous coating to add magnetically conductive properties to the non-magnetically conductive material.

10. The method of claim 1 wherein a recess is formed under the first plate adjacent the opening and the magnetic regions, wherein the recess is equal to the thickness of the plate.

11. The method of claim 1 wherein a recess is formed under both sides of the opening.

12. The method of claim 1, wherein the magnetic regions are further defined as first and second magnets and wherein the first magnet has a different pole from the second magnet.

13. The method of claim 1, wherein the magnetic, pole of the magnetic region adjacent the opening of the first plate alternates and the cumulative strength of all the magnetic regions per pole is about the same.

14. A method for holding a ferrous object comprising the steps of:

providing a first plate having at least one opening;

providing a first magnet and a second magnet disposed on the first plate on opposite sides of a null region spanning the opening;

providing a second plate disposed on a side of the magnets opposite the first plate, wherein the magnetic field between the magnets are focused in the at least one opening of the first plate; and placing the ferrous object against a side of the first plate opposite the magnets in such an orientation that at least some portion of the object lies over some portion of the opening.

15. A method for holding a tool comprising:

providing a first plate having two or more slots therein;

providing three or more magnets disposed on the first plate adjacent to null regions spanning the slots, the magnetic poles of the magnets on opposite sides of each slot having opposite polarities;

providing a second plate disposed on the magnets opposite the first plate, wherein the magnetic field of the magnets is focused in the slots of the first plate; and placing the tool against the side of the first plate opposite the magnets in such an orientation that at least some portion of the tool lies over some portion of one of the slots.

* * * * *